US005320779A

United States Patent [19]

Fivizzani

[11] Patent Number: 5,320,779

[45] Date of Patent: * Jun. 14, 1994

[54] USE OF MOLYBDATE AS CORROSION INHIBITOR IN A ZINC/PHOSPHONATE COOLING WATER TREATMENT

[75] Inventor: Kenneth P. Fivizzani, Naperville, Ill.

[73] Assignee: Nalco Chemical Company, Naperville, Ill.

[ * ] Notice: The portion of the term of this patent subsequent to Mar. 9, 2010 has been disclaimed.

[21] Appl. No.: 999,795

[22] Filed: Jun. 6, 1991

[51] Int. Cl.[5] ..... C23F 11/167

[52] U.S. Cl. ..... 252/394; 252/389.22; 252/389.23; 252/389.52; 252/389.53; 252/389.54; 210/696; 210/700; 210/701; 422/15; 422/16; 422/17; 422/18

[58] Field of Search ..... 252/389.54, 387, 389.52, 252/389.53, 394, 389.22, 389.23; 210/700, 701, 696; 422/15, 16, 17, 18

[56] References Cited

U.S. PATENT DOCUMENTS 4,446,028 5/1984 Becker ..... 210/697

5,192,447 3/1993 Fivizzani ..... 210/697

*Primary Examiner*—Robert L. Stoll

*Assistant Examiner*—Valerie Fee

*Attorney, Agent, or Firm*—Robert A. Miller; Joseph B. Barrett; James J. Drake

[57] ABSTRACT

A corrosion inhibitor treatment composition for cooling water systems is disclosed in which no chromate is used and no free orthophosphate is present comprising a combination of a localized corrosion inhibitor in the form of a salt of molybdenum, vanadium, or tungsten, a general corrosion and scale inhibitor comprising zinc or nickel, a pair of organic phosphonates, and a stabilizing agent.

20 Claims, No Drawings

USE OF MOLYBDATE AS CORROSION INHIBITOR IN A ZINC/PHOSPHONATE COOLING WATER TREATMENT

BACKGROUND OF THE INVENTION

This invention relates generally to a treatment of water used in recirculating cooling water systems and more particularly to a water treatment composition which effectively controls corrosion and scale formation, which does not rely in any way upon chromate and which will not release orthophosphate into the environment.

Corrosion occurs when metals are oxidized to their respective ions or insoluble salts. For example, corrosion of metallic iron can involve conversion to soluble iron in a +2 or +3 oxidation state or to formation of insoluble iron oxides and hydroxides. Metal loss from the solubilization of the iron causes the structural integrity of the system to deteriorate over time. Leakage between the water system and process streams can ultimately occur. Also, corrosion contributes to the formation of insoluble salts and the resultant buildup of deposits which impede heat transfer and fluid flow.

Chromate has traditionally been an extremely effective and widely used corrosion inhibitor. During recent years, however, the use of chromate has come under increasing scrutiny due to environmental concerns. In light of this, it is most desirable to develop chromate-free, environmentally acceptable corrosion inhibitors.

Similarly, orthophosphate has traditionally been used as a scale inhibitor. The release of free orthophosphate into water systems has come under increasing scrutiny also due to environmental concerns. It is therefore also desirable to develop environmentally acceptable orthophosphate-free scale inhibitors.

DETAILED DESCRIPTION OF THE INVENTION

It is therefore the principal object of this invention to provide a new, environmentally acceptable chemical treatment program which will inhibit corrosion in recirculating cooling water systems.

The present invention is directed to a corrosion inhibitor treatment composition for recirculating cooling water systems which does not utilize chromate and will not introduce excess orthophosphate. The corrosion inhibitor treatment composition comprises a combination of a localized corrosion inhibitor and a general corrosion and scale inhibitor as described below, as well as a stabilizing agent.

The Localized Corrosion Inhibitors

The localized corrosion inhibitors that can be used in this invention include the water-soluble salts of molybdenum, vanadium, and tungsten in which the metals have an oxidation state of at least +5 and preferably +6.

A preferred localized corrosion inhibitor is a water-soluble salt of molybdenum such as a sodium, potassium or ammonium salt of molybdenum. The most preferred localized corrosion inhibitor is sodium molybdate. The molybdenum salt should be present in the range of about 4 to about 20 ppm by weight molybdate anion, preferably in the range of about 5 to about 10 ppm most preferably at a level of about 10 ppm.

Another useful localized corrosion inhibitor is a water-soluble salt of vanadium. Such useful localized corrosion inhibitors include sodium, potassium and ammonium salts of vanadium. The most preferred localized corrosion inhibitor is sodium metavanadate. When a vanadium salt is used in the treatment composition, it should be present in the range of about 4 to about 20 ppm by weight vanadate anion, preferably about 4 to about 10 ppm and most preferably at a level of about 4 ppm.

Water-soluble salts of tungsten could also be used as localized corrosion inhibitors in the practice of this invention, at levels commensurate with those described for vanadium and molybdenum.

The General Corrosion and Scale Inhibitors

The general corrosion and scale inhibitor used in the invention comprises a combination of zinc and/or nickel with a pair of organic phosphonates, as discussed below.

The Organic Phosphonates

This invention requires the use of two different organic phosphonates. The first organic phosphonate is 2-phosphonobutane-1,2,4tricarboxylic acid (PBTC).

The second organic phosphonate must be chosen from the group comprising 1-hydroxyethylidene-1,1-diphosphonic acid (HEDP) and aminotrimethylenephosphonic acid. The most preferred organic phosphonate from this group is HEDP which will decompose in the presence of chlorine. One product of this decomposition is orthophosphate. Thus HEDP is a potential source of orthophosphate ions which, unlike in prior art systems which rely on orthophosphate per se, are immediately consumed and therefore not released into the system water.

The combination of organic phosphonates should be used at a level in the range of about 4 to about 20 ppm by weight, more preferably in the range of about 4 to about 8 ppm preferably at a level of about 8 ppm, the weight ratio of PBTC to HEDP of from about 0.5:1 to 4:1, preferably about 0.5:1 to 2:1 and most preferably about 2:1.

The Zinc/Nickel

Any water-soluble salt of zinc or nickel in which the metal is in the +2 oxidation state can be used. $Zn^{+2}$ is preferred. Convenient sources of the salt include zinc oxide, zinc chloride, and zinc sulfate. One preferred source of $Zn^{+2}$ is zinc oxide.

The metal should be present in the treatment composition in the range of about 0.5 to about 5 ppm by weight, preferably in the range of about 1 to about 3 ppm, and most preferably at a level of about 2 ppm.

The Stabilizing Agent

A stabilizing agent is used to prevent the zinc or nickel from precipitating out of solution. The stabilizing agent also helps disperse and suspend scale and thereby contributes to the control of scale buildup on heat transfer surfaces. Anionic polymers are generally suitable stabilizing agents in the practice of this invention. The most preferred stabilizing agents to be used in the treatment composition of the present invention as scale inhibitors and dispersants include terpolymers of acrylic acid, methacrylic acid, and N-tertiary butyl acrylamide or homopolymers, copolymers, terpolymers, or the like, which contain at least one mole percent of a randomly repeating or blocked monomer unit having the structure:

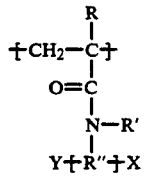

wherein R is H, $CH_3$, or mixtures thereof;

R' is H, $C_{1-4}$alkyl, or mixtures thereof;

R'' is alkylene (linear) having from 1-16 carbon atoms, or cyclic, aryl, alkaryl, aralkyl, or mixtures thereof X is sulfonate, phosphonate, phosphite, or mixtures thereof Y is H, —OH, —NR'$_2$, —NR'$_3$+Z$^-$, —$CO_2$M, and mixtures thereof and where Z is an ion, and M is H, alkali cation, alkaline earth cation, ammonium cation, or mixtures thereof.

Tolyltriazole (TT) or benzotriazole may be added to the treatment composition as a corrosion inhibitor for yellow metals. Tolyltriazole is preferred.

The polymers should be present at a level in the range of about 5 to 15 ppm by weight, preferably in the range of about 7 to 10 ppm and most preferably at a level of about 7 ppm tolyltriazole is used, it should be present in the range of about 1 to 10 ppm by weight. In a preferred embodiment of the invention, tolyltriazole will be present in the range of about 1 to 3 ppm. In the most preferred embodiment of the invention, tolyltriazole is present at a level of about 1.9 ppm.

The following examples are intended to be illustrative of the present invention and to teach one of ordinary skill how to make and use the treatment composition. These examples are not intended to limit the invention or its protection in any way.

EXAMPLE 1

The treatment composition is prepared as a two-component system. The first component is acidic, consisting of $Zn^{+2}$ and the two organic phosphonates. The second component is basic, consisting of the polymer, tolyltriazole and molybdate. Each component is fed separately to the cooling tower.

The corrosion and. scale inhibitor treatment composition for cooling water systems in accordance with the present invention consists of 10 ppm molybdate anion, 2 ppm $Zn^{+2}$, 4 PBTC, 2 ppm HEDP, 7 ppm of a terpolymer of acrylic acid, methacrylic acid, and N-tertiary butyl acrylamide, and 1.9 ppm tolyltriazole. The treatment composition was tested in water containing 600 ppm Ca and 335 ppm Mg; and having a total alkalinity of 700 (all as $CaCO_3$). A pH level of 8.0 was maintained.

Recorded below in Table 1 are the test results. The superior corrosion inhibiting capacity of this treatment composition will be evident to those skilled in the art.

TABLE 1

| Average Deposit Rate (mg/cm$^2$ yr) | | | Average Corrosion Rate (mpy) |
|---|---|---|---|
| mild (carbon) steel (n = 2) | admiralty brass (n = 2) | stainless steel (n = 1) | mild (carbon) steel (n = 2) |
| 36.4 | 2.9 | 1.12 | 1.1 |

EXAMPLE 2

Three different treatment compositions were prepared to illustrate the ability of the organic phosphonates to inhibit corrosion independently of one another as well as in concert with one another. The treatment composition containing PBTC as the only organic phosphonate was tested in a softer, less corrosive water. The treatment compositions and their respective test conditions are recorded in Table 2.

TABLE 2

| | (1) | (2) | (3) |
|---|---|---|---|
| | 10 ppm molybdate | 10 ppm molybdate | 10ppm molybdate |
| | 2 ppm $Zn^{+2}$ | 2 ppm $Zn^{+2}$ | 1ppm $Zn^{+2}$ |
| | 4 ppm PBTC | — | 4ppm PBTC |
| | 4 ppm HEDP | 4 ppm HEDP | — |
| | 7 ppm terpolymer* | 7 ppm terpolymer* | 5ppm terpolymer* |
| | 1.9 ppm TT | 1.9 ppm TT | 1.9ppm TT |
| Water hardness: | 600 ppm Ca<br>335 ppm Mg<br>(all as $CaCO_3$) | 600 ppm Ca<br>335 ppm Mg<br>(all as $CaCO_3$) | 360 ppm Ca<br>200 ppm Mg<br>(all as $CaCO_3$) |
| Total Alkalinity: | 700 (as $CaCO_3$) | 700 (as $CaCO_3$) | 400 (as $CaCO_3$) |
| pH: | 8.0 | 8.0 | 8.5 |

*terpolymer of acrylic acid, methacrylic acid, and N-tertiary butyl acrylamide

Table 3 illustrates that superior scale and corrosion inhibition is achieved when the treatment composition contains both PBTC and HEDP. Similarly, Table 4 indicates that the extent of corrosion is significantly greater when HEDP and PBTC are used independently of one another. It should also be noted that the treatment composition containing the pair of organic phosphonates performed significantly better than the one containing only PBTC even though the water conditions were much harder when both phosphonates were used.

TABLE 3

| Organic Phosphonate(s) in Treatment Composition (ppm) | Average Deposit Rate (mg/cm$^2$ yr) mild (carbon) steel (n = 3) | admiralty brass (n = 2) | stainless steel (n = 1) |
|---|---|---|---|
| (1) 4 HEDP and 4 PBTC | 39.3 | 4.30 | 1.06 |
| (2) 4 HEDP | 268 | 8.32 | 8.92 |
| (3) 4 PBTC | 737 | 3.29 | 3.33 |

TABLE 4

| Organic Phosphonate(s) in Treatment Composition (ppm) | Average Corrosion Rate (mpy) mild (carbon) steel (n = 3) |
|---|---|
| (1) 4 HEDP and 4 PBTC | 1.1 |
| (2) 4 HEDP | 8.3 |
| (3) 4 PBTC | 24.1 |

While the present invention is described above in connection with preferred or illustrative embodiments, the embodiments are not intended to be exhaustive or limiting of the invention. Rather, the invention is intended to cover all alternatives, modifications and equivalents including within its spirit and scope, as defined by the appended claims.

What is claimed is:

1. A corrosion and scale inhibitor treatment composition for cooling water systems comprising:

(a) a localized. corrosion inhibitor chosen from the group consisting of water-soluble salts of molybdenum, vanadium, and tungsten;

(b) a general corrosion and scale inhibitor comprising the combination of zinc and/or nickel with a pair of organic phosphonates, the first of said organic phosphonates being 2-phosphonobutane-1,2,4tricarboxylic acid and the second of said organic phosphonates chosen from the group consisting of 1-hydroxyethylidene-1,1-diphosphonic acid and aminotrimethylene phosphonic acid; and (c) a stabilizing agent which is an anionic polymer.

2. The corrosion and scale inhibitor treatment composition of claim 1 in which the localized corrosion inhibitor has an oxidation state of at least +5.

3. The corrosion and scale inhibitor treatment composition of claim 1 in which the localized corrosion inhibitor has an oxidation state of at least +6.

4. The corrosion and scale inhibitor treatment composition of claim 1 in which the localized corrosion inhibitor is a water-soluble salt of molybdenum.

5. The corrosion and scale inhibitor treatment composition of claim 4 in which a sufficient quantity of the localized corrosion inhibitor is present in the treatment to provide for about 4 to 20 ppm by weight of the inhibitor based on the cooling water being treated.

6. The corrosion and scale inhibitor treatment composition of claim 4 in which a sufficient quantity of the localized corrosion inhibitor is present in the treatment to provide for about 5 to 10 ppm by weight of the inhibitor based on the cooling water being treated.

7. The corrosion and scale inhibitor treatment composition of claim 4 in which a sufficient quantity of the localized corrosion inhibitor is present in the treatment to provide for about 10 ppm by weight of the inhibitor based on the cooling water being treated.

8. The corrosion and scale inhibitor treatment composition of claim 1 in which the localized corrosion inhibitor is water-soluble salt of vanadium.

9. The corrosion and scale inhibitor treatment composition of claim 8 in which a sufficient quantity of the localized corrosion inhibitor is present in the treatment to provide for about 4 to 20 ppm by weight of the inhibitor based on the cooling water being treated.

10. The corrosion and scale inhibitor treatment composition of claim 8 in which a sufficient quantity of the localized corrosion inhibitor is present in the treatment to provide for about 4 to 10 ppm by weight of the inhibitor based on the cooling water being treated.

11. The corrosion and scale inhibitor treatment composition of claim 8 in which a sufficient quantity of the localized corrosion inhibitor is present in the treatment to provide for about 4 ppm by weight of the inhibitor based on the cooling water being treated.

12. The corrosion and scale inhibitor treatment composition of claim 1 in which the second organic phosphonate is 1-hydroxyethylidene-1,1-diphosphonic acid.

13. The corrosion and scale inhibitor treatment composition of claim 1 in which the first and second organic phosphonate are present in the treatment composition at a level sufficient to provide about 2 to 10 ppm by weight of each in the cooling water system.

14. The corrosion and scale inhibitor treatment composition of claim 1 in which the combination of the first and second organic phosphonate, the first of said organic phosphonates being 2-phosphonobutane-1,2,4,tricarboxylic acid and the second of said organic phosphonates being 1-hydroxyethylidene-1,1-diphosphonic acid, are present in the treatment composition at a ratio of about 0.5:1 to 4:1.

15. The corrosion and scale inhibitor treatment composition of claim 1 in which the combination of the first and second organic phosphonate, the first of said organic phosphonates being 2-phosphonobutane-1,2,4,tricarboxylic acid and the second of said organic phosphonates being 1-hydroxyethylidene-1,1-diphosphonic acid, are present in the treatment composition at a ratio of about 0.5:1 to 2:1.

16. The corrosion and scale inhibitor treatment composition of claim 1 in which the combination of the first and second organic phosphonate, the first of said organic phosphonates being 2-phosphonobutane-1,2,4,tricarboxylic acid and the second of said organic phosphonates being 1-hydroxyethylidene-1,1-diphosphonic acid, are present in the treatment composition at a ratio of about 2:1.

17. The corrosion and scale inhibitor treatment composition of claim 1 in which the stabilizing agent is chosen from the group comprising homopolymers, copolymers, terpolymers, or the like, which contain at least one mole percent of a randomly repeating or blocked monomer unit having the structure:

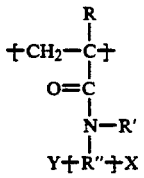

wherein R is H, $CH_3$, or mixtures thereof;

R′ is H, $C_{1-4}$alkyl, or mixtures thereof;

R″ is alkylene (linear) having from 1–16 carbon atoms, or cyclic, aryl, alkaryl, aralkyl, or mixtures thereof X is sulfonate, phosphonate, phosphite, or mixtures thereof Y is H, —OH, $—NR'_2$, $—NR'_3{+}Z^-$, $—CO_2M$, and mixtures thereof and where Z is an ion, and M is H, alkali cation, alkaline earth cation, ammonium cation, or mixtures thereof.

18. The corrosion and scale inhibitor treatment composition of claim 1 in which the stabilizing agent is a terpolymer of acrylic acid, methacrylic acid, and N-tertiary butyl acrylamide.

19. The corrosion and scale inhibitor treatment composition of claim 1 in which a corrosion inhibitor for yellow metals, chosen from the group consisting of tolyltriazole and benzotriazole, is introduced.

20. The corrosion and scale inhibitor treatment composition of claim 19 in which the corrosion inhibitor for yellow metals is tolyltriazole.

* * * * *